US010556186B2

(12) United States Patent
Rebbie et al.

(10) Patent No.: US 10,556,186 B2
(45) Date of Patent: Feb. 11, 2020

(54) SINGLE SEAT ROLLER COASTER CAR

(71) Applicant: Philadelphia Toboggan Coasters, Inc., Hatfield, PA (US)

(72) Inventors: Thomas D. Rebbie, Quakertown, PA (US); Philip A. Zirkelbach, Pennsburg, PA (US); Richard W. Snyder, Quakertown, PA (US); Torrence V. Jenkins, Jr., Denver, PA (US); Adam M. Blocklinger, Sellersville, PA (US); Adam J. Turley, Hatfield, PA (US)

(73) Assignee: Philadelphia Toboggan Coasters, Inc., Hatfield, PA (US)

( * ) Notice: Subject to any disclaimer, the term of this patent is extended or adjusted under 35 U.S.C. 154(b) by 536 days.

(21) Appl. No.: 15/336,282

(22) Filed: Oct. 27, 2016

(65) Prior Publication Data

US 2017/0120154 A1 May 4, 2017

Related U.S. Application Data

(60) Provisional application No. 62/248,610, filed on Oct. 30, 2015.

(51) Int. Cl.
*A63G 7/00* (2006.01)
*B61D 15/00* (2006.01)

(52) U.S. Cl.
CPC ..... *A63G 7/00* (2013.01); *B61D 15/00* (2013.01)

(58) Field of Classification Search
CPC ..... A63G 7/00; B61D 15/00
(Continued)

(56) References Cited

U.S. PATENT DOCUMENTS 1,480,678 A * 1/1924 Feucht ..... A63G 7/00 213/46 R
6,269,750 B1 * 8/2001 Cornwell ..... A63G 7/00 104/124

(Continued)

FOREIGN PATENT DOCUMENTS

WO WO 99/22829 5/1999

OTHER PUBLICATIONS

International Search Report for related PCT Application No. PCT/US2016/058754 dated Feb. 3, 2017.

*Primary Examiner* — Scott A Browne
(74) *Attorney, Agent, or Firm* — Caesar Rivise, PC

(57) ABSTRACT

An apparatus and method for creating enhanced articulation in a roller coaster car. The apparatus and method involve a single seat roller coaster car that has only back track wheel assemblies secured to its chassis. The front end of the chassis has a coupling arm fixedly secured at one arm end. The other arm end includes a rod end that is received within the chassis of a lead car, or another roller coaster car. This lead car, or this other roller "secondary" coaster car, has a receiver to which the rod end from the coupling arm of the roller coaster car is attached. This coupling configuration, in combination with the omission of any front track wheel assemblies on the roller coaster car, allows the roller coaster car to articulate through a solid angle in 360° in an x-y plane. The rod end/receiver coupling is located underneath the seat of either the lead car or another secondary roller coaster car, thereby forming a "coupling compartment". Removing the seat cushion provides access to this coupling compartment.

12 Claims, 10 Drawing Sheets

(58) Field of Classification Search
USPC ..... 104/63, 299, 76, 135, 272; 105/3, 4.1
See application file for complete search history.

(56) References Cited

U.S. PATENT DOCUMENTS

| | | | | |
|---|---|---|---|---|
| 6,523,634 | B1 * | 2/2003 | Gagnon | B60K 15/01 180/215 |
| 7,159,520 | B2 * | 1/2007 | Casey | A63G 7/00 104/63 |
| 2003/0017782 | A1 * | 1/2003 | Man | A63H 18/16 446/431 |
| 2006/0065151 | A1 | 3/2006 | Casey et al. | |
| 2011/0319179 | A1 * | 12/2011 | Howard | A63G 7/00 472/43 |
| 2013/0020847 | A1 * | 1/2013 | Smith | B60N 2/688 297/228.13 |
| 2013/0025492 | A1 | 1/2013 | Crawford et al. | |
| 2015/0251619 | A1 | 9/2015 | Sutherland | |

* cited by examiner

SINGLE SEAT ROLLER COASTER CAR

CROSS-REFERENCE TO RELATED APPLICATIONS

This non-provisional application claims the benefit under 35 U.S.C. § 119(e) of Application Ser. No. 62/248,610 filed on Oct. 30, 2015 entitled SINGLE SEAT ROLLER COASTER CAR and whose entire disclosure is incorporated by reference herein.

BACKGROUND OF THE INVENTION

The present invention relates generally to amusement rides and, more particularly, to a roller coaster car that can better articulate in different directions than existing roller coaster cars.

As shown in FIGS. 1A-1B, existing roller coaster cars 1 comprise front 4A and back track wheel 4B assemblies and in many instances comprise two seats, a front seat 5A and a rear seat 5B; it should be understood that the terms "front track wheel assembly 4A" and "back track wheel assembly 4B" imply a corresponding wheel assembly (although not shown) on the other side (viz., the right side) of the roller coaster cars 2 and 3 since only the left side of these cars 2/3 are shown in FIGS. 1A-1B. Furthermore, adjacent roller coaster cars are coupled to each other by a coupling arm 6 that connects between the back end of a first car and the front end of the following car, more particularly, referred to as rear RD and front FD drawheads, respectively. In particular, as shown most clearly in FIG. 1B, the coupling arm 6 has a first rod end 6A secured to a first coupler pin 7A that is mounted in the rear drawhead RD; similarly, coupling arm 6 has a second rod end 6B secured to a second coupler pin 7B that is mounted in the front drawhead FD. For added safety, safety chains SC are connected between respective eyebolts (only two of which EB are shown) located in the front and rear drawheads FD/RD. It should be noted that the front FD and rear RD drawheads each comprise a unitary element.

The presence of the front track wheel assemblies 4A in each of the cars following the "lead car" provide front-end support of these following cars 3 (hereinafter referred to as "secondary cars"). Because of this front-end support, the coupling arm 6 between the lead car 2 and the following car 3 and between all of the other secondary cars (although not shown) is an external connection at the back of the car in front and at the front end of the following car, at the respective drawheads, mentioned previously.

Although the front-end support of each secondary car permits the use of this externally-connected coupling arm, one disadvantage of the front-end support is that it minimizes "articulation" of the secondary car 3.

Thus, there remains a need for a roller coaster car that can experience an enhanced articulation when coupled to the lead car or any secondary car during roller coaster operation.

All references cited herein are incorporated herein by reference in their entireties.

BRIEF SUMMARY OF THE INVENTION

A roller coaster car assembly adapted for operation on a roller coaster track and for experiencing enhanced articulation is disclosed. The roller coaster car assembly comprises: a lead car comprising: a first chassis having first and second portions, wherein the first portion articulates with respect to the second portion, and wherein the first portion comprises front track wheel assemblies and the second portion comprises first back track wheel assemblies; wherein the second portion has a first aperture and a first receiver at a first back end thereof; and wherein a first passenger seat is secured to the second portion of the first chassis; and a secondary car comprising: a second chassis having a second aperture and a second receiver at a second back end thereof; a single pair of track wheel assemblies, wherein the single pair of track wheel assemblies is coupled only at a back portion of the second chassis; a second passenger seat secured to said second chassis; and a coupling arm having a first end fixedly secured to said second chassis and a second end coupled to said first receiver via said first aperture, said secondary car experiencing enhanced articulation when said roller coaster car assembly is in operation.

A roller coaster car that is adapted to connect to a lead car, or to another roller coaster car other than a lead car, and to experience enhanced articulation during roller coaster operation is disclosed. The roller coaster car comprises: a chassis having an aperture at a back end thereof; track wheel assemblies secured only at a back end of the chassis; a passenger seat secured to the chassis; and a coupling arm having a first end fixedly secured to the chassis and a second end adapted to coupling within a lead car chassis or within a chassis of another roller coaster car; and wherein the roller coaster car experiences enhanced articulation when the roller coaster car is coupled to the lead car or to another roller coaster car during roller coaster operation.

A method of providing enhanced articulation to a roller coaster car on a roller coaster ride track is disclosed. The method comprises: securing roller coaster wheel assemblies to only the back end of a chassis of the roller coaster car; securing a seat to the chassis of the roller coaster car; securing a first end of a coupling arm to a front end of the chassis; adapting a second end of the coupling arm to be received within a lead roller coaster car chassis or within another roller coaster car chassis that is forward of the roller coaster car; and causing the roller coaster car to be pulled along the roller coaster ride track to effect the enhanced articulation.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
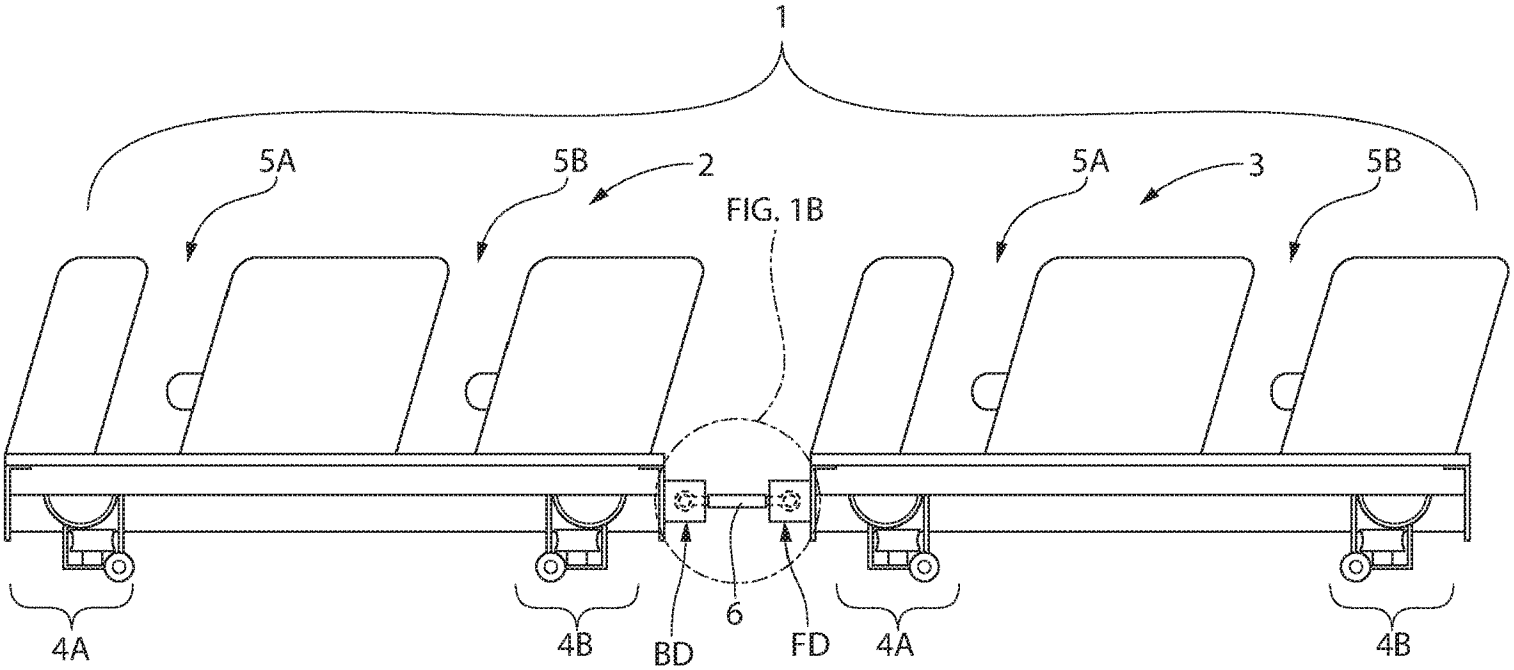
FIG. 1A (PRIOR ART)
FIG. 1A is a side view of two prior art limited-articulating roller coaster cars, e.g., a lead car and a secondary car, coupled together with the roller coaster track and the safety chains omitted for clarity.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 1B:
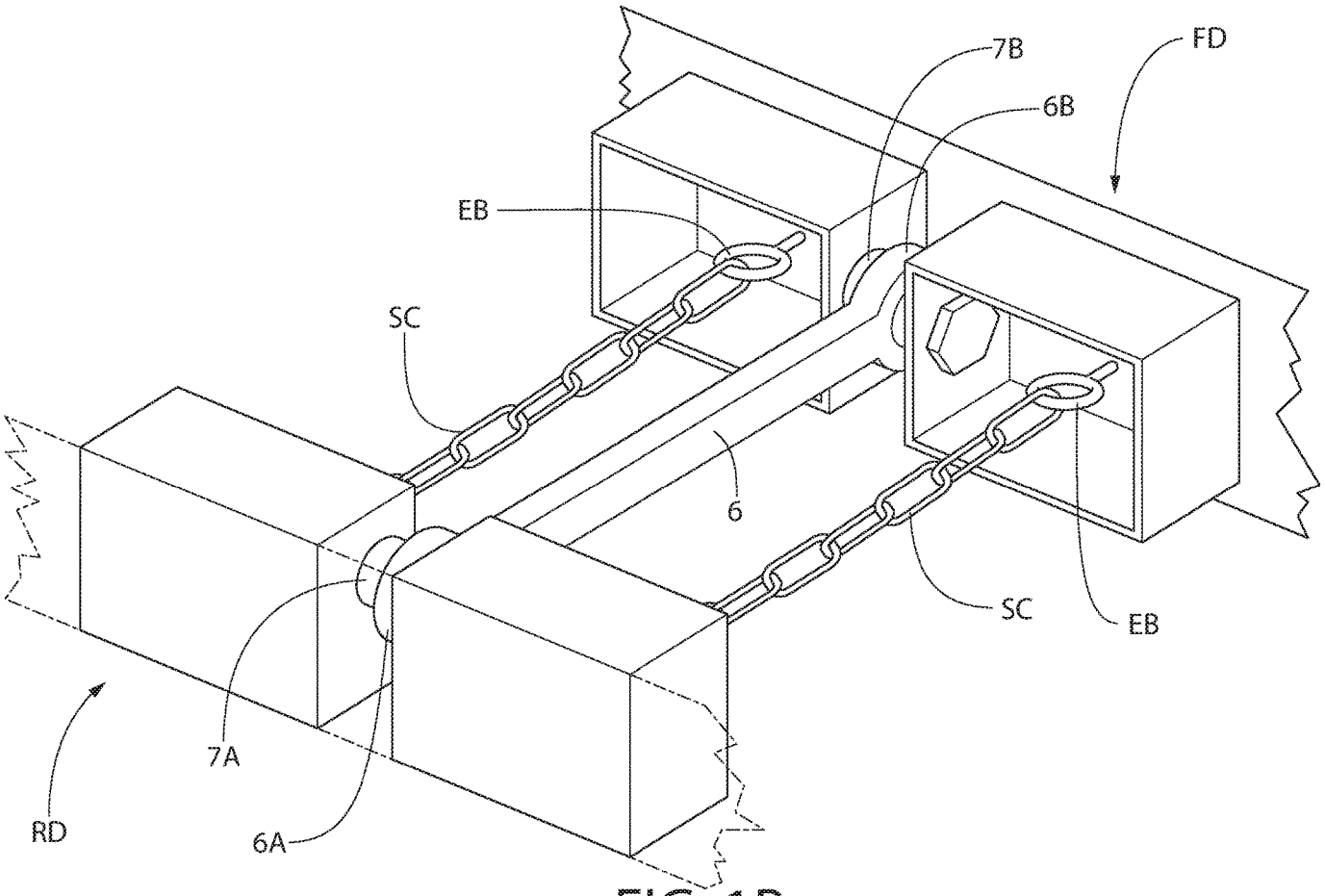
FIG. 1B (PRIOR ART)
FIG. 1B is a partial isometric view of the external coupling mechanism of the two prior art limited-articulating roller coaster cars of FIG. 1A showing the safety chains.
Figure 2:
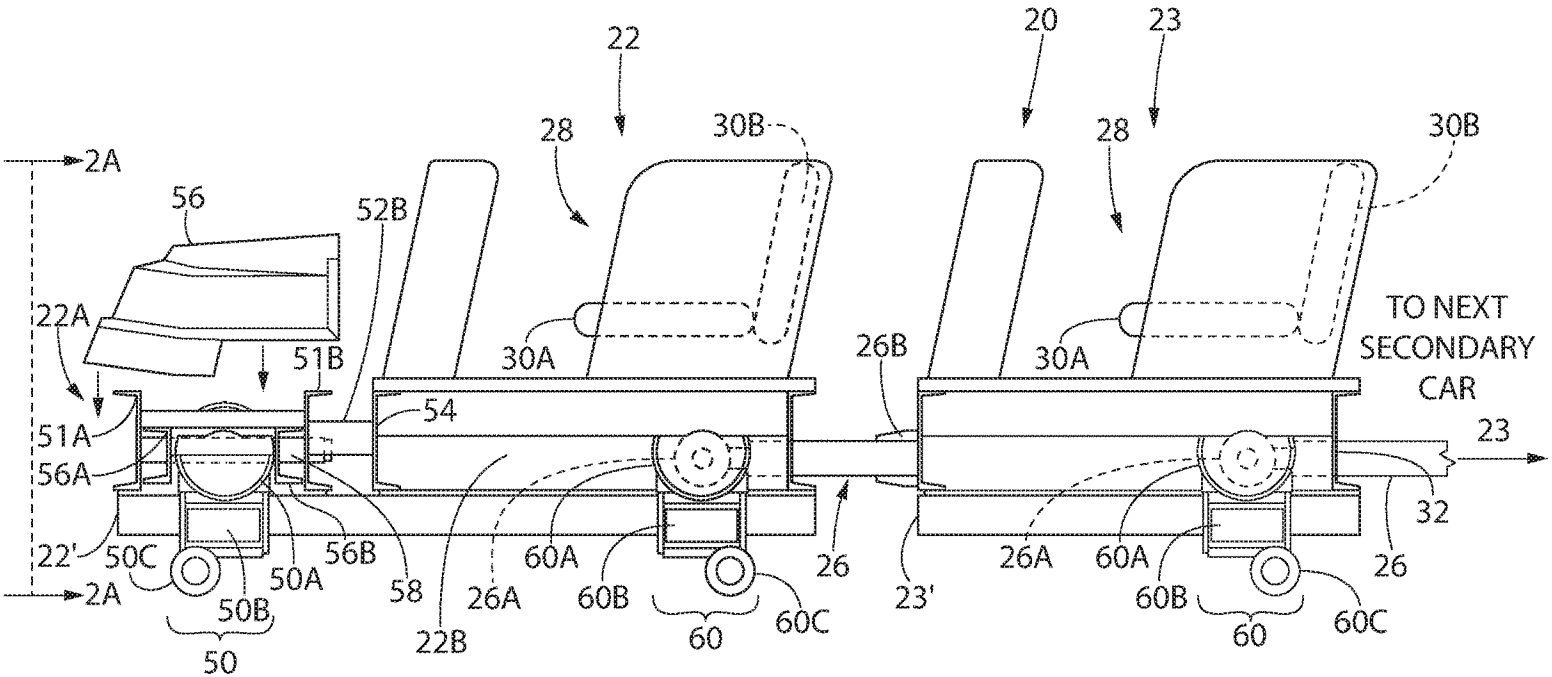
FIG. 2 is a side view of a lead car and a secondary car of the present invention coupled together and depicting no front track wheel assemblies for the secondary car.
Figure 2A:
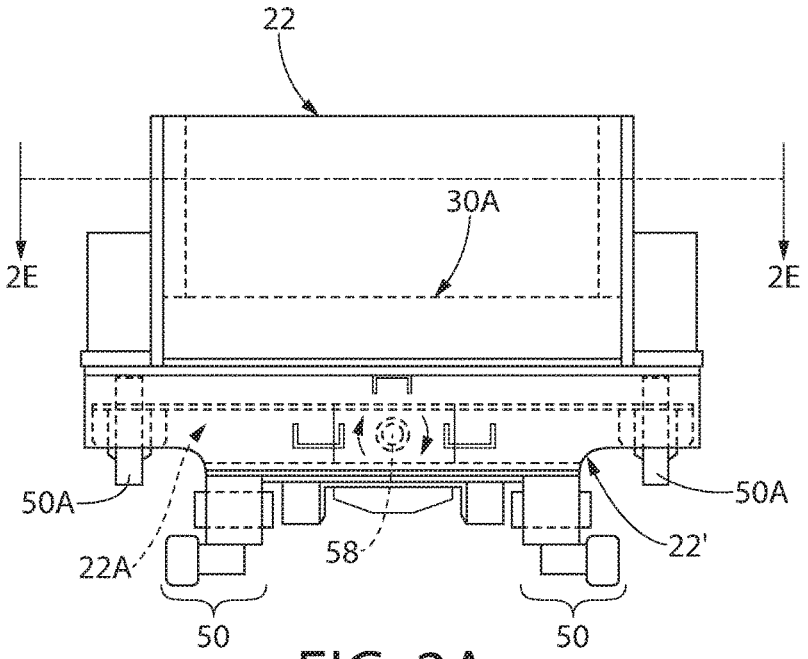
FIG. 2A is a front view of the lead car of the present invention with the articulating unit cover omitted and with a majority of the articulating unit shown hatched for clarity.
Figure 2B:
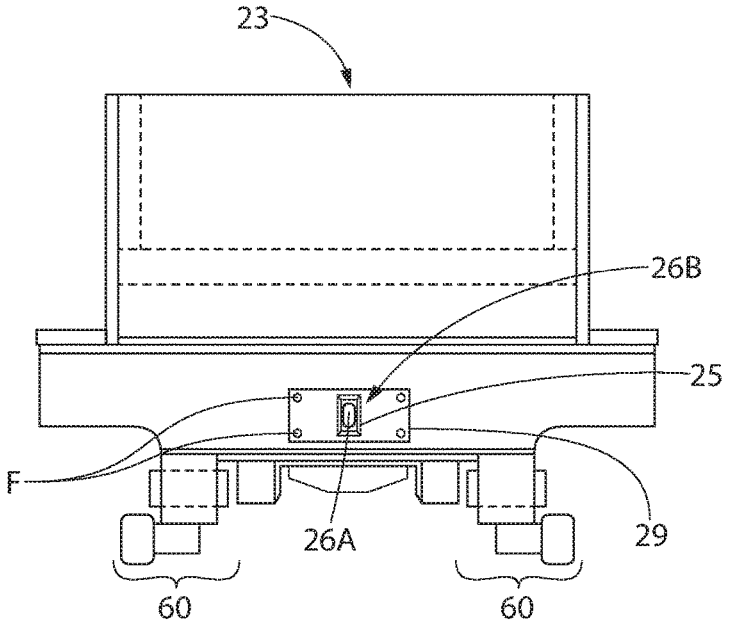
FIG. 2B is a front view of the secondary car of the present invention.
Figure 5:
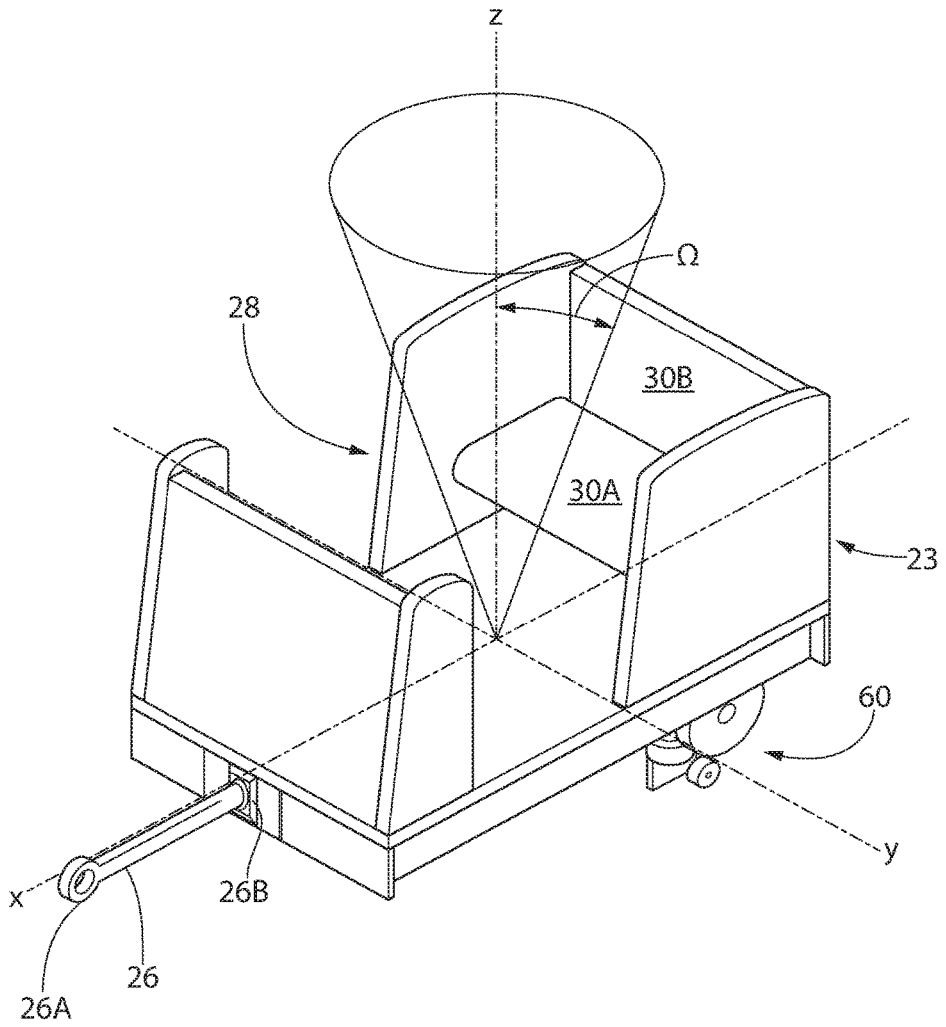
FIG. 5 is an isometric view of a secondary car of the present invention depicting the enhanced articulation motion of the secondary car.

As shown in FIGS. 2-2B, invention 20 of the present application comprises a lead roller coaster car 22 and at least one secondary car 23. Each car 22 and 23 comprises a respective chassis 22' and 23' and both cars comprise a single seat 28. Each seat 28 is fixedly secured (e.g., using fasteners or welded, etc.) to a respective chassis 22' and 23'. It should be noted that the roller coaster track and the safety chains are omitted for clarity. One of the key features of the present invention 20 is that every secondary roller coaster car 23 comprises no front track wheel assemblies (see FIG. 2) as compared to the prior art limited-articulating roller coaster secondary cars 3 which do include front wheel assemblies 4A (see FIG. 1A). As a result of this, the front of each secondary car 23 in the present invention 20 is able to "articulate" in a solid angle Ω (e.g., 9°) in the range of 360° in the x-y plane, as shown most clearly in FIG. 5. In addition, the smaller size and weight of the secondary car 23 assist in facilitating this enhanced articulation which is not experienced by conventional roller coaster cars, such as those shown in FIGS. 1A-1B. A single pair of back track wheel assemblies 60 are secured to the chassis 23' (e.g., via fasteners, welding, etc.).

Figure 2C:
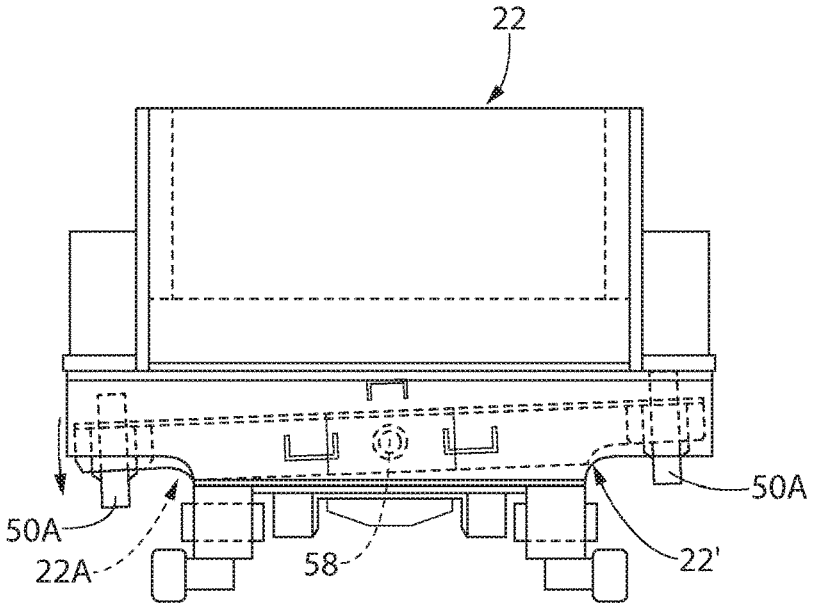
FIG. 2C is a front view of the lead car of the present invention showing the articulating unit articulating to the right and with the articulating unit cover omitted and with a majority of the articulating unit shown hatched for clarity.
Figure 2D:
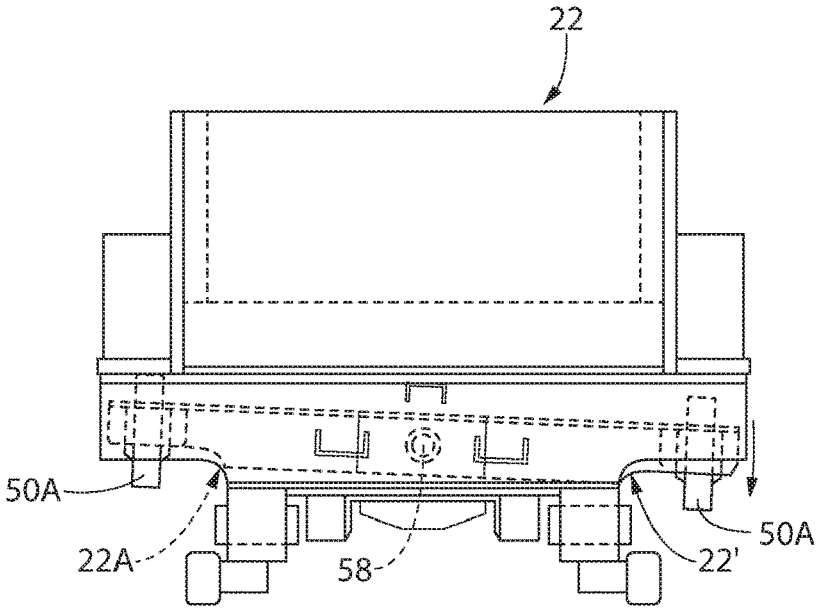
FIG. 2D is a front view of the lead car of the present invention showing the articulating unit articulating to the left and with the articulating unit cover omitted and with a majority of the articulating unit shown hatched for clarity.
Figure 2E:
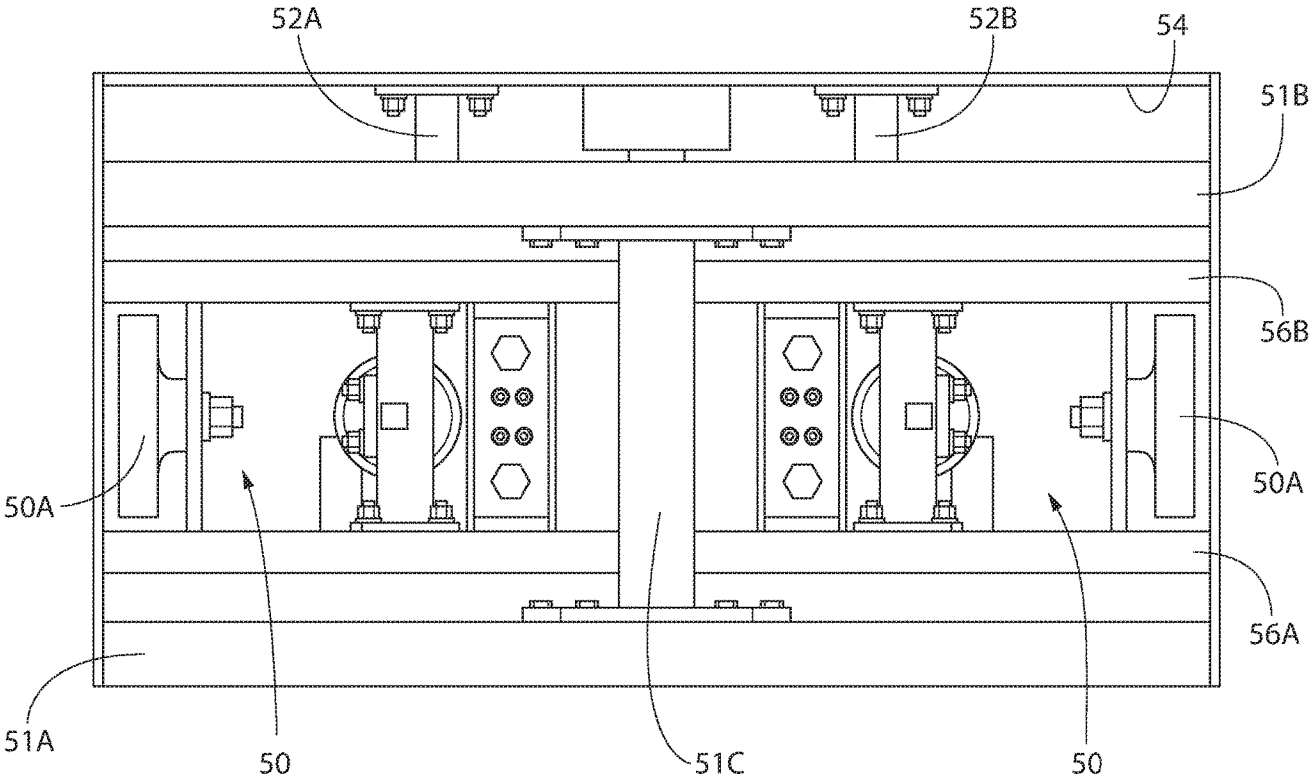
FIG. 2E is a plan view of the articulating unit (with the cover omitted) taken long line 2E-2E of FIG. 2A.

As mentioned above, the lead car 22 of the present invention 20 includes the chassis 22'. The chassis 22' comprises a two part design: an articulating unit 22A attached to the front end of the passenger portion 22B, thereby forming the front end of the lead car 22. The articulating unit 22A assists in steering the lead car 22 on the track (not shown) while also providing for a smoother ride. In particular, the articulating unit 22A is pivotally mounted within a framework that is formed by a front support 51A and a back support 51B, coupled together using several crossbars (one of which, 51C, is clearly shown in FIG. 2E). The back support 51B is fixedly secured (e.g., bolted, welded, etc.) to a passenger chassis bracket 54 via supports 52A and 52B. The articulating unit 22A comprises its own framework having a front support 56A and back support 56B with tractor wheels 50A (FIG. 2A) located on each side of the articulating unit 22A; the tractor wheels 50A ride on the track (not shown). A pivot axle 58, aligned in the longitudinal direction, is positioned between the front and back supports 56A/56B and it is about this pivot axle 58 that the articulating unit framework pivots. Thus, as the track (not shown) twists and turns, so does the articulating unit 22A (FIGS. 2C-2D); the articulating unit 22A twists more than the passenger portion 22B, thereby helping to steer the lead car 22 and provide a smoother ride. In addition, a housing or cover 56 (e.g., metal or plastic) is releasably secured over the articulating unit 22A as is also shown in FIG. 2.

As also shown in FIG. 2, each tractor wheel 50A is associated with a friction wheel 50B and a safety wheel 50C to form a lead car wheel assembly 50. It should be noted that the rear wheel assemblies 60 of both the lead car 22 and the secondary cars 23 each comprise a tractor wheel 60A, a friction wheel 60B and a safety wheel 60C (FIG. 2), located on both sides of the secondary car 23 in the rear (e.g., see FIG. 2B).

To effect this enhanced articulation of the secondary cars 23 discussed previously, while coupling the secondary cars to the lead car 22 or to another secondary car 23, a coupling arm 26 is provided. The coupling arm 26 is fixedly secured (e.g., welded, fasteners, etc.) at one end 26B to the front of the secondary car 23; by way of example, the end 26B can be welded 25 (FIG. 2B) to a plate or member 29 that is fastened F (e.g., bolts, screws, etc.) to the chassis. The other end of the coupling arm comprises a rod end 26A. As shown most clearly in FIGS. 3-4, to secure the rod end 26A to the forward car (whether it be the lead car 22 or another secondary car 23), the assembler slides the rod end 26A through an aperture 32 in the back end of the forward car chassis 22' and aligns the rod end 26A with coupling pin holes 34A/34B in the receiver 36. A coupling pin 27 is then slid through one of the coupling holes 34A/34B, through the aligned rod end 26A and then through the other coupling pin hole 34A/34B, as shown in FIG. 4. It should be understood that FIG. 4 depicts the general securement of the rod end 26A in the receiver 36. However, FIG. 4A provides a more complete and detailed depiction of the rod end 26A connection within the receiver 36. In particular, spacers 38A/38B are provided on the coupling pin 27 on each side of the rod end 26A; the spacers 38A/38B maintain the rod end 26A away from the receiver plates 36 during operation. Furthermore, to lock the coupling pin 27 in the receiver 36, capture plates 40A/40B are secured over the coupling pin 27 ends against each receiver plate 36 using fasteners F (e.g., bolts) through holes H (FIG. 3) in the receiver plates 36. Safety wires (not shown) are also used to further secure the capture plates 38A/38B over the coupling pin 27.

Access to the receiver 36 when installing the coupling pin 27 is achieved by removing the bottom seat cushion 30A (FIGS. 2 and 5) of the seat 28; the back support cushion 30B of the seat 28 is fixedly secured (e.g., fasteners, adhesives, etc.) to the cars 22/23. Once the coupling arm 26 is installed, the bottom seat cushion 30A is re-installed in the car 22/23. It should be noted that the components shown in FIGS. 3-4 form a "coupling compartment" that is covered by the bottom seat cushion 30A; as such, the assembler obtains access to the coupling compartment when engaging or disengaging a secondary car 23 located behind the car whose bottom seat cushion 30A has been removed.

Figure 3:
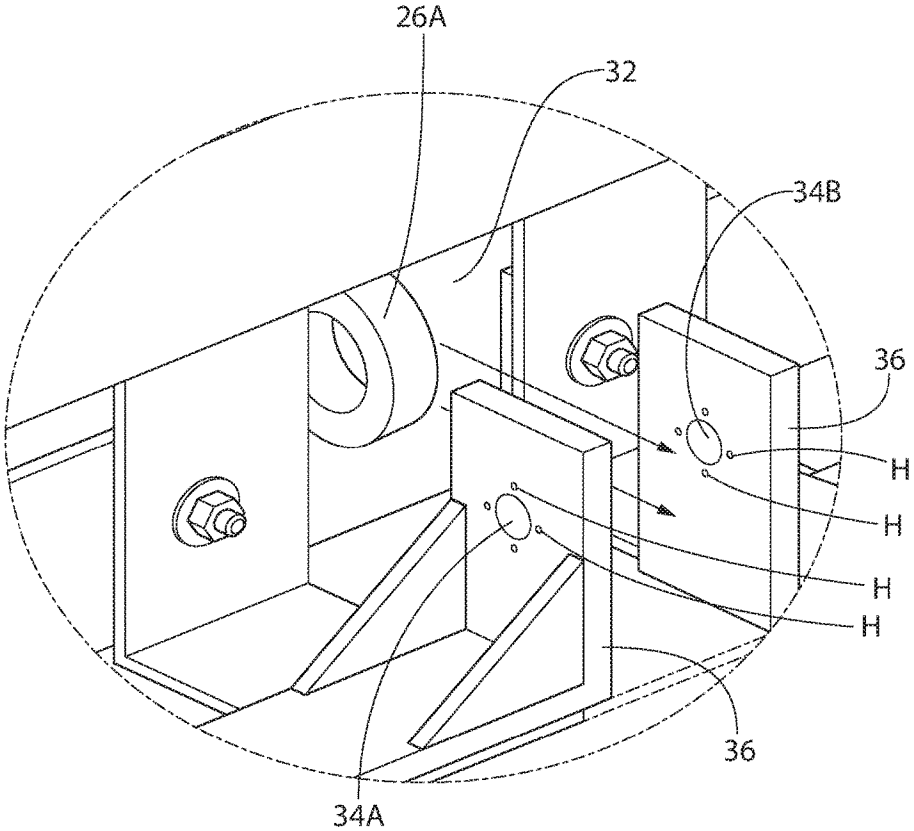
FIGS. 3-4A are partial isometric views depicting how the rod end of the coupling arm of the present invention is coupled to a receiver via a coupling pin under the seat of the lead car (as well as secondary cars)
Figure 4:
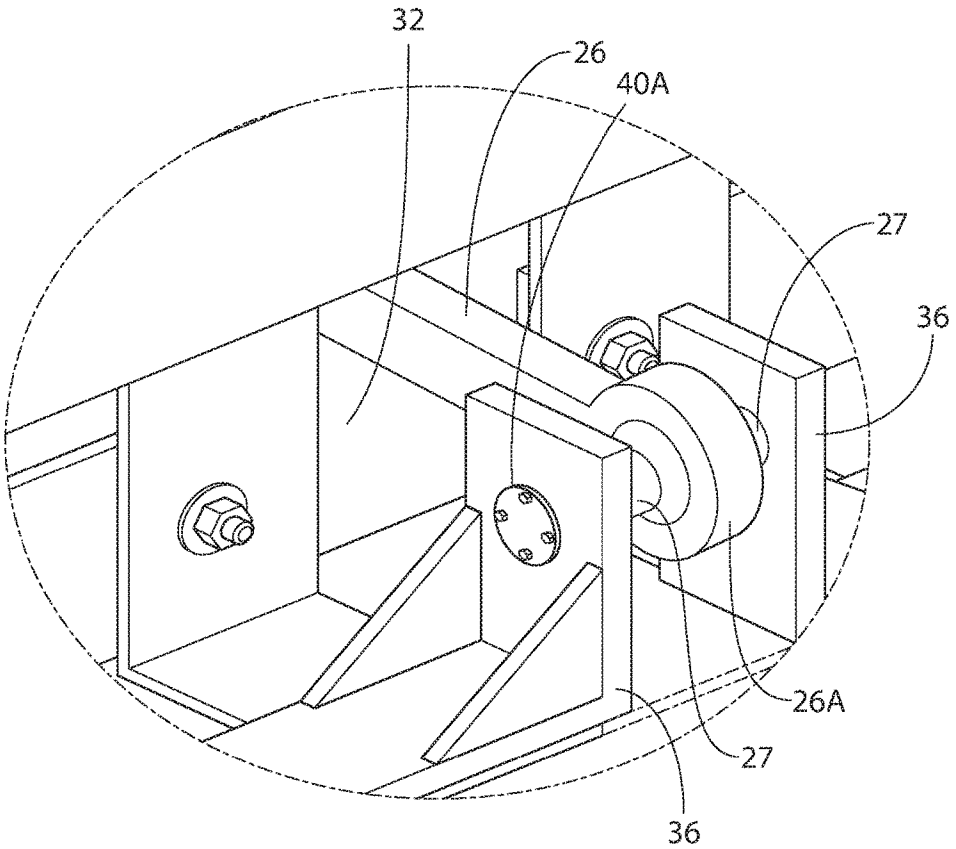
Figure 4A:
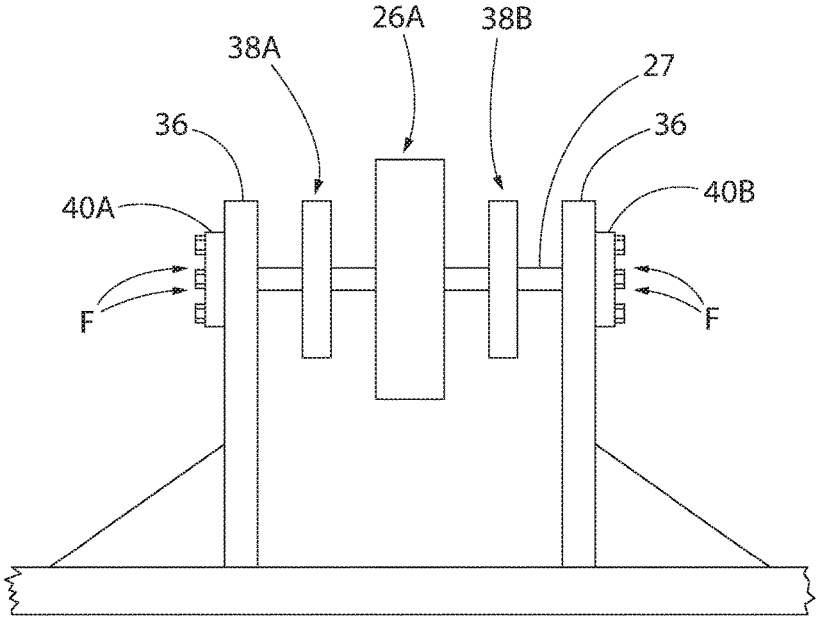

Similarly, another secondary car (not shown) can be serially-coupled to the secondary car 23, as indicated in FIG. 2, since the chassis 23' of the secondary car 23 also comprises a corresponding aperture 32 and corresponding receiver 36, coupling pin holes 34A/34B, a corresponding coupling pin 27, spacers 38A/38B, capture plates 40A/40B (as depicted in FIGS. 3-4A), all for receiving the rod end 26A of the coupling arm 26 of another secondary car (not shown).

While the invention has been described in detail and with reference to specific examples thereof, it will be apparent to one skilled in the art that various changes and modifications can be made therein without departing from the spirit and scope thereof.

What is claimed is:

1. A roller coaster car assembly adapted for operation on a roller coaster track and for experiencing enhanced articulation, said roller coaster car assembly comprising:

a lead car comprising:

a first chassis having first and second portions, said first portion articulating with respect to said second portion, said first portion comprising front track wheel assemblies and said second portion comprising first back track wheel assemblies;

said second portion having a first aperture and a first receiver at a first back end thereof;

a first passenger seat secured to said second portion of said first chassis, said first passenger seat comprising a bottom cushion that is removable; and a secondary car comprising:

a second chassis having a second aperture and a second receiver at a second back end thereof;

a single pair of track wheel assemblies, said single pair of track wheel assemblies being coupled only at a back portion of said second chassis;

a second passenger seat secured to said second chassis; and a coupling arm having a first end fixedly secured to said second chassis and a second end comprising a rod end that is adapted to couple to said first receiver, within said first chassis, via said first aperture, said bottom cushion covering an access to said rod end and said first receiver; and wherein said secondary car experiences enhanced articulation when said roller coaster car assembly is in operation.

2. The roller coaster car assembly of claim 1 wherein said second receiver is adapted to be coupled to another coupling arm via said second aperture from another secondary car that is positioned behind said secondary car.

3. The roller coaster car assembly of claim 1 wherein said first end is welded to a member that is fastened to said second chassis.

4. The roller coaster car assembly of claim 1 wherein said first portion articulates with respect to said second portion for providing a smooth ride while assisting in steering said lead car.

5. A roller coaster car that is adapted to connect to a lead car, or to another roller coaster car other than a lead car, and to experience enhanced articulation during roller coaster operation, said roller coaster car comprising:

a chassis having an aperture at a back end thereof;

track wheel assemblies secured only at a back end of said chassis;

a passenger seat secured to said chassis and wherein said passenger seat comprises a bottom cushion that is removable; and a coupling arm having a first end fixedly secured to said chassis and a second end comprising a rod end that is adapted to couple to a receiver located within a lead car chassis or within a chassis of another roller coaster car positioned in front of said roller coaster car;

said bottom cushion covering an access to another rod end of another coupling arm of another roller coaster car, located behind said roller coaster car, and wherein said another rod end is adapted to be coupled to a receiver in said roller coaster car via said aperture; and wherein said roller coaster car experiences enhanced articulation when said roller coaster car is coupled to the lead car or to another roller coaster car during roller coaster operation.

6. The roller coaster car of claim 5 wherein said first end is welded to a member that is fastened to said chassis.

7. The roller coaster car of claim 5 wherein said lead car chassis comprises a first portion that articulates with respect to a second portion, said articulating first portion providing a smooth ride while assisting in steering said lead car.

8. The roller coaster car of claim 7 wherein said first portion and said second portion each comprise their own pair of wheel assemblies.

9. A method of providing enhanced articulation to a roller coaster car on a roller coaster ride track, said method comprises:

securing roller coaster wheel assemblies to only the back end of a chassis of said roller coaster car;

securing a seat to the chassis of said roller coaster car;

securing a first end of a coupling arm to a front end of said chassis;

adapting a second end of said coupling arm to be received within a lead roller coaster car chassis or within another roller coaster car chassis that is forward of said roller coaster car, said adapting comprising providing a rod end on said second end that is configured to couple to a receiver located within the lead roller coaster car chassis or within said another roller coaster car chassis positioned in front of said roller coaster car, said rod end coupled to said receiver forming components of a coupling compartment;

providing a removable seat cushion that acts as a cover to said coupling compartment; and causing said roller coaster car to be pulled along the roller coaster ride track to effect said enhanced articulation.

10. The method of claim 9 wherein said first end is welded to a member that is fastened to said chassis.

11. The method of claim 9 further comprising the step of providing a lead car having a two portion chassis configuration, wherein a front portion of said chassis articulates with respect to a back portion of said chassis, said back portion comprising a seat.

12. The method of claim 11 wherein said step of providing a lead car having a two portion chassis configuration comprises providing a respective pair of wheel assemblies to said front and back portions.

* * * * *